US009101020B2

(12) United States Patent
Wang et al.

(10) Patent No.: US 9,101,020 B2
(45) Date of Patent: Aug. 4, 2015

(54) LED DRIVER CAPABLE OF REGULATING POWER DISSIPATION AND LED LIGHTING APPARATUS USING SAME

(71) Applicant: LUXMILL ELECTRONIC CO., LTD., Hsinchu County (TW)

(72) Inventors: Shih Yu Wang, Hsinchu County (TW); Hui Teng Tsai, Hsinchu County (TW); Mao Feng Lan, Hsinchu County (TW); Tien Pao Lee, Hsinchu County (TW)

(73) Assignee: LUXMILL ELECTRONIC CO., LTD., Hsinchu County (TW)

( * ) Notice: Subject to any disclaimer, the term of this patent is extended or adjusted under 35 U.S.C. 154(b) by 9 days.

(21) Appl. No.: 13/941,675

(22) Filed: Jul. 15, 2013

(65) Prior Publication Data

US 2015/0015159 A1 Jan. 15, 2015

(51) Int. Cl.
*H05B 33/08* (2006.01)

(52) U.S. Cl.
CPC ..... *H05B 33/0818* (2013.01)

(58) Field of Classification Search
USPC ..... 315/172, 194, 209 R, 247, 248, 291, 224
See application file for complete search history.

(56) References Cited

U.S. PATENT DOCUMENTS

| | | | | |
|---|---|---|---|---|
| 6,288,501 | B1 * | 9/2001 | Nakamura et al. | 315/307 |
| 6,333,605 | B1 * | 12/2001 | Grouev et al. | 315/291 |
| 8,476,965 | B2 * | 7/2013 | Santo et al. | 327/538 |
| 8,847,515 | B2 * | 9/2014 | King et al. | 315/307 |
| 8,896,284 | B2 * | 11/2014 | Fan | 323/285 |
| 2007/0171146 | A1 * | 7/2007 | Lee et al. | 345/39 |
| 2010/0039038 | A1 * | 2/2010 | Lam et al. | 315/224 |
| 2010/0315019 | A1 * | 12/2010 | Hoogzaad et al. | 315/291 |
| 2010/0327835 | A1 * | 12/2010 | Archibald | 323/282 |
| 2011/0273102 | A1 * | 11/2011 | van de Ven et al. | 315/193 |
| 2012/0187863 | A1 * | 7/2012 | Nonaka et al. | 315/291 |
| 2013/0082611 | A1 * | 4/2013 | Cohen | 315/185 R |
| 2013/0147360 | A1 * | 6/2013 | Kang | 315/122 |
| 2014/0111110 | A1 * | 4/2014 | Qi et al. | 315/210 |
| 2014/0160801 | A1 * | 6/2014 | Stamm | 363/21.01 |

* cited by examiner

*Primary Examiner* — Jimmy Vu
*Assistant Examiner* — Syed M Kaiser
(74) *Attorney, Agent, or Firm* — Ming Chow; Sinorica, LLC

(57) ABSTRACT

An LED driver having one end coupled with an LED module and another end coupled to a ground, being capable of generating a duty current and a duty in response to a dropout voltage across the LED driver in a way that, the duty current will increase and the duty will decrease when the dropout voltage exceeds a first threshold, and the duty current will decrease and the duty will increase when the dropout voltage falls below a second threshold.

10 Claims, 3 Drawing Sheets

LED DRIVER CAPABLE OF REGULATING POWER DISSIPATION AND LED LIGHTING APPARATUS USING SAME

BACKGROUND OF THE INVENTION

1. Field of the Invention

The present invention relates to an LED (light emitting diode) driver, especially to an LED driver capable of regulating its power dissipation when driving an LED module.

2. Description of the Related Art

For general LED lighting apparatuses which have a driver for LEDs, as the lifetime of an LED is extremely long, and often longer than that of the driver, the operating lifetime of the LED lighting apparatuses is therefore determined by the driver rather than by the LEDs. In other words, if the power dissipation of the driver is not well controlled, the operating lifetime of an LED lighting apparatus can be much shorter than expected.

Please refer to FIG. 1, which illustrates a circuit diagram of a prior art LED lighting apparatus. As illustrated in FIG. 1, the prior art LED lighting apparatus includes an LED module 100 and a driver circuit 110.

The LED module 100 has a first end coupled with a line voltage $V_{IN}$, which is a processed voltage from an AC line and can be a DC voltage or a full-wave rectified voltage, and a second end coupled with the driver circuit 110.

The driver circuit 110 has a third end coupled with the second end, a fourth end coupled with a reference voltage $V_{REF}$, and a fifth end coupled to a ground. The driver circuit 110 includes an amplifier 111, an NMOS (N type metal oxide semiconductor) transistor 112, and a resistor 113. The amplifier 111 has a positive input end, a negative input end, and an output end, the positive input end being coupled with the fourth end. The NMOS transistor 112 has a drain, a gate, and a source, the drain being coupled with the third end, the gate being coupled with the output end of the amplifier 111, and the source being coupled with the negative input end of the amplifier 111. The resistor 113 has one end coupled with the source, and another end coupled with the fifth end.

When in operation, the LED module 100 has a first voltage $V_1$ between the first end and the second end, and the driver circuit 110 has a second voltage $V_2$ between the third end and the fifth end, wherein $V_{IN}=V_1+V_2$, and the driver circuit 110 will force the voltage at the negative input end of the amplifier 111 to follow the reference voltage $V_{REF}$, so as to result in a constant current $I_O=V_{REF}/$(the resistance of the resistor 113). However, when $V_{IN}$ increases due to a variation of the AC line, or $V_1$ decreases due to a temperature increment, $V_2$ will increase and the power dissipation in the driver circuit 110 will increase accordingly, which may cause an overheat and may thereby damage the driver circuit 110.

To solve the foregoing problem, a novel LED driver is needed.

SUMMARY OF THE INVENTION

One objective of the present invention is to disclose an LED driver capable of regulating its power dissipation when driving an LED module.

Another objective of the present invention is to disclose an LED driver capable of protecting itself from getting overheated when driving an LED module.

Still another objective of the present invention is to disclose an LED driver capable of providing a longer operating lifetime for an LED lighting apparatus.

To attain the foregoing objectives, an LED driver capable of regulating power dissipation is proposed, including:

a variable reference voltage generator, used to generate a variable reference voltage in response to a first digital control signal and a second digital control signal in a way that, when the first digital control signal is at a high level and the second digital control signal is at a low level, the variable reference voltage will be increasing; and when the second digital control signal is at a high level and the first digital control signal is at a low level, the variable reference voltage will be decreasing;

a variable duty generator, used to generate a first switching signal and a second switching signal in response to the first digital control signal and the second digital control signal in a way that, the second switching signal is a complementary version of the first switching signal, and when the first digital control signal is at a high level and the second digital control signal is at a low level, a duty of the first switching signal will be increasing; and when the second digital control signal is at a high level and the first digital control signal is at a low level, the duty of the first switching signal will be decreasing;

an amplifier having a positive input end, a negative input end, and an output end, the positive input end being coupled with the variable reference voltage;

a first switch having a first channel end, a second channel end, and a first control end, the first channel end being coupled with the output end of the amplifier, and the first control end being coupled with the first switching signal, wherein, when the first switching signal is at a high level, the first channel end will be coupled electrically with the second channel end;

a second switch having a third channel end, a fourth channel end, and a second control end, the third channel end being coupled with the second channel end of the first switch, the fourth channel end being coupled to a ground, and the second control end being coupled with the second switching signal, wherein, when the second switching signal is at a high level, the third channel end will be coupled electrically with the fourth channel end;

an NMOS transistor having a drain, a gate, and a source, the drain being coupled with one end of an LED module, the gate being coupled with the second channel end of the first switch, and the source being coupled with the negative input end of the amplifier, wherein another end of the LED module is coupled with a line voltage;

a resistor having one end coupled with the source of the NMOS transistor, and another end coupled with the ground;

a first comparator having a first positive input end, a first negative input end, and a first output end, the first positive input end being coupled with the drain of the NMOS transistor, the first negative input end being coupled with a first threshold voltage, and the first output end providing the first digital control signal; and a second comparator having a second positive input end, a second negative input end, and a second output end, the second positive input end being coupled with a second threshold voltage, the second negative input end being coupled with the drain of the NMOS transistor, and the second output end providing the second digital control signal.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

The spirit of the present invention is to disclose an LED driver, which is in series with an LED module and capable of generating a duty current and a duty in response to a dropout voltage across the LED driver in a way that, the duty current will increase and the duty will decrease when the dropout voltage exceeds a first threshold, and the duty current will decrease and the duty will increase when the dropout voltage falls below a second threshold, wherein the product of the duty current and the duty makes an average current for the LED module, and the first threshold is higher than the second threshold.

The present invention will be described in more detail hereinafter with reference to the accompanying drawings that show the preferred embodiments of the invention.

Figure 1:
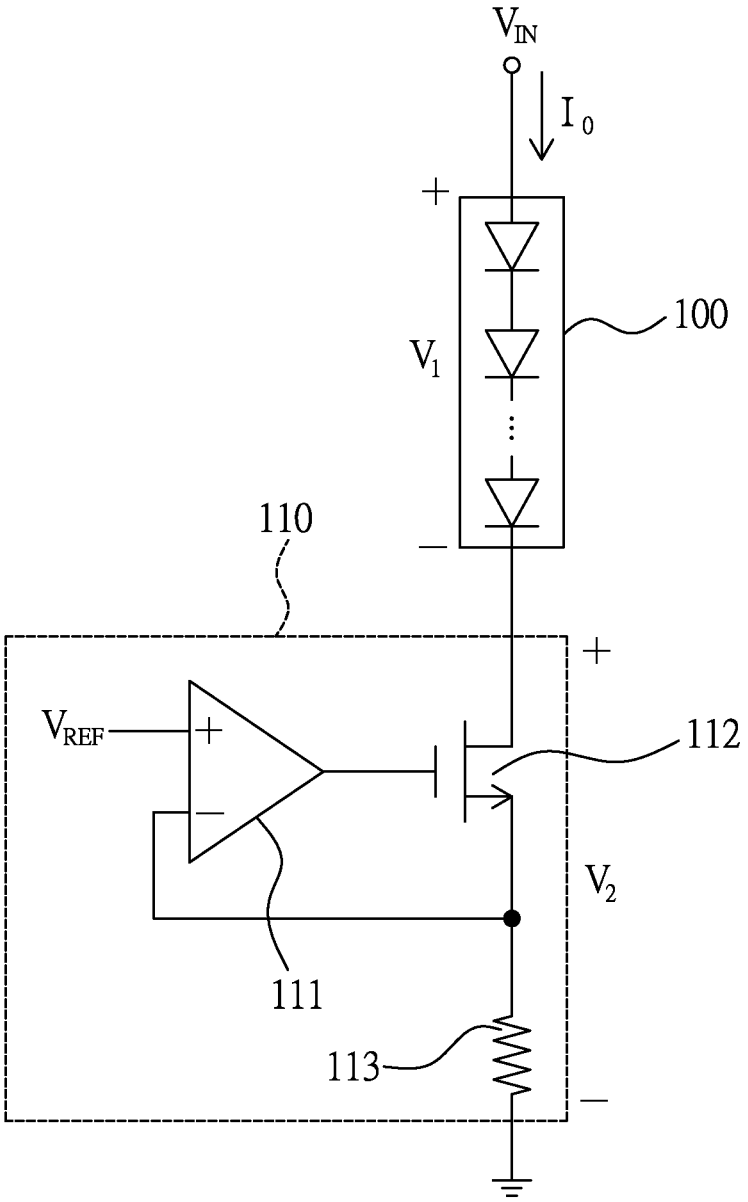
(PRIOR ART) FIG. 1
FIG. 1 illustrates a circuit diagram of a prior art LED lighting apparatus.
Figure 2:
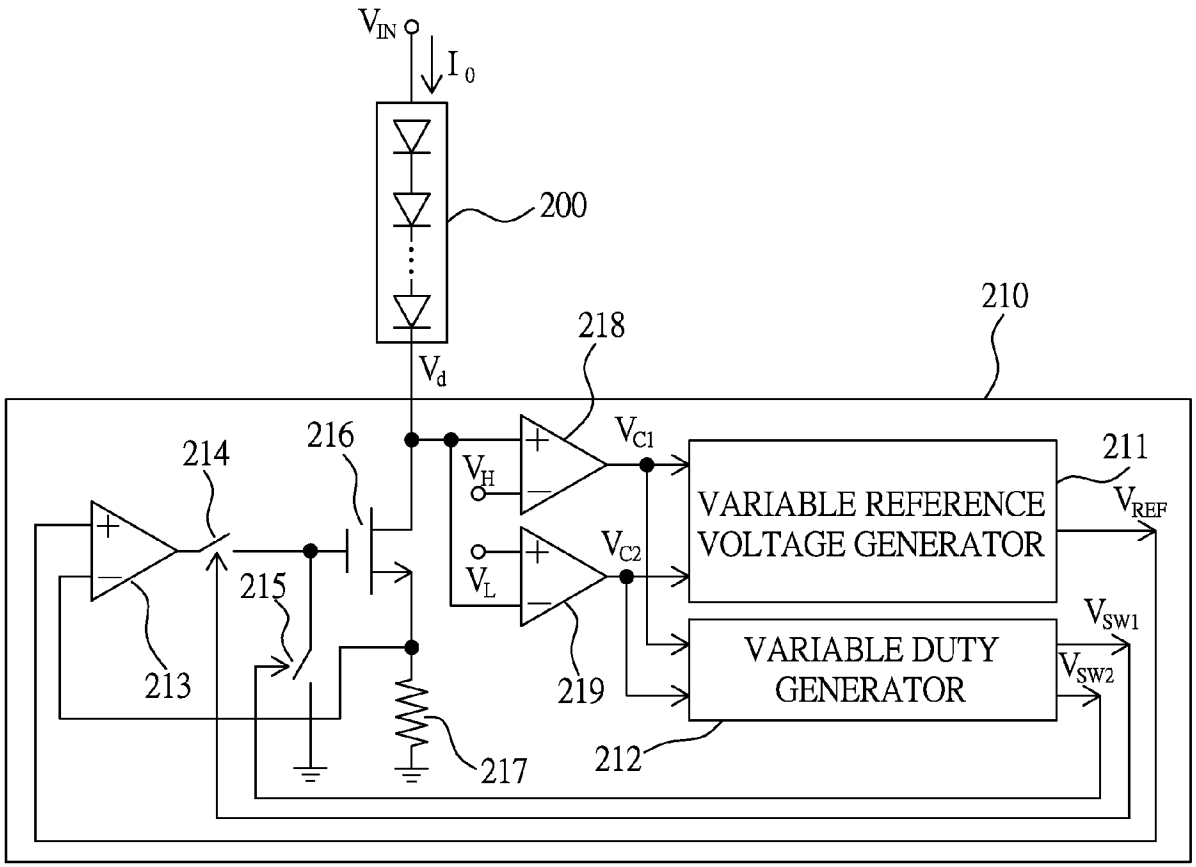
FIG. 2 illustrates a circuit diagram of an LED lighting apparatus including an LED driver capable of regulating power dissipation according to a preferred embodiment of the present invention.

Please refer to FIG. 2, which illustrates a circuit diagram of an LED lighting apparatus including an LED driver capable of regulating power dissipation according to a preferred embodiment of the present invention. As illustrated in FIG. 2, the LED lighting apparatus includes an LED module 200 and an LED driver 210, and the LED driver 210 is in series with the LED module 200.

The LED module 200, including at least one LED, has a first end coupled with a line voltage $V_{IN}$, which is a DC voltage or a processed voltage—a half-wave rectified voltage or a full-wave rectified voltage—from an AC line, and a second end coupled with the driver 210.

The LED driver 210 includes a variable reference voltage generator 211, a variable duty generator 212, an amplifier 213, a first switch 214, a second switch 215, an NMOS transistor 216, a resistor 217, a first comparator 218, and a second comparator 219.

The variable reference voltage generator 211 is used to generate a variable reference voltage $V_{REF}$ in response to a first digital control signal $V_{C1}$ and a second digital control signal $V_{C2}$, following a principle that, when $V_{C1}$ is at a high level and $V_{C2}$ is at a low level, $V_{REF}$ will be increasing; and when $V_{C2}$ is at a high level and $V_{C1}$ is at a low level, $V_{REF}$ will be decreasing. Based on the principle, the variable reference voltage generator 211 can be implemented by a digital circuit, which, for example, includes an up/down counter and a digital-to-analog converter (not shown in the figure), and the up/down counter will count upwards when $V_{C1}$ is at a high level and $V_{C2}$ is at a low level, and count downwards when $V_{C2}$ is at a high level and $V_{C1}$ is at a low level, so as to increase or decrease the variable reference voltage $V_{REF}$. The variable reference voltage generator 211 can also be implemented by an analog circuit, which, for example, includes a current source, a capacitor, and a switch circuit (not shown in the figure), and the switch circuit will make the current source charge the capacitor when $V_{C1}$ is at a high level and $V_{C2}$ is at a low level, and couple a discharging path with the capacitor to discharge the capacitor when $V_{C2}$ is at a high level and $V_{C1}$ is at a low level, so as to increase or decrease the variable reference voltage $V_{REF}$.

The variable duty generator 212 is used to generate a first switching signal $V_{SW1}$ and a second switching signal $V_{SW2}$ in response to the first digital control signal $V_{C1}$ and the second digital control signal $V_{C2}$, the second switching signal $V_{SW2}$ being a complementary version of the first switching signal $V_{SW1}$. The variable duty generator 212 can be implemented, for example, by an oscillator (not shown in the figure), which provides the first switching signal $V_{SW1}$ and the second switching signal $V_{SW2}$, and the duties thereof are controlled by $V_{C1}$ and $V_{C2}$.

The amplifier 213 has a positive input end, a negative input end, and an output end, the positive input end being coupled with the variable reference voltage $V_{REF}$.

The first switch 214 has a first channel end, a second channel end, and a first control end, the first channel end being coupled with the output end of the amplifier 213, and the first control end being coupled with the first switching signal $V_{SW1}$. When $V_{SW1}$ is at a high level, the first channel end will be coupled electrically with the second channel end, and the NMOS transistor 216 will then be driven by the amplifier 213.

The second switch 215 has a third channel end, a fourth channel end, and a second control end, the third channel end being coupled with the second channel end of the first switch 214, the fourth channel end being coupled to a ground, and the second control end being coupled with the second switching signal $V_{SW2}$. When $V_{SW2}$ is at a high level, the third channel end will be coupled electrically with the fourth channel end, and the NMOS transistor 216 will then be turned off.

The NMOS transistor 216 has a drain, a gate, and a source, the drain being coupled with the second end of the LED module 200, the gate being coupled with the second channel end of the first switch 214, and the source being coupled with the negative input end of the amplifier 213.

The resistor 217 having one end coupled with the source of the NMOS transistor 216, and another end coupled with the ground, is used to set a duty current $I_O$ flowing through the LED module 200 according to an equation: $I_O = V_{REF}$/(the resistance of the resistor 217).

The first comparator 218 has a first positive input end, a first negative input end, and a first output end, the first positive input end being coupled with the drain of the NMOS transistor 216, the first negative input end being coupled with a first threshold voltage $V_H$, and the first output end providing the first digital control signal $V_{C1}$.

The second comparator 219 has a second positive input end, a second negative input end, and a second output end, the second positive input end being coupled with a second threshold voltage $V_L$, the second negative input end being coupled with the drain of the NMOS transistor 216, and the second output end providing the second digital control signal $V_{C2}$.

When in operation, a dropout voltage $V_d$ across the LED driver 210 will be regulated to stay between $V_H$ and $V_L$, irrespective of a change of $V_{IN}$ caused by a variation of the AC line, or a change of the voltage drop of the LED module 200 caused by temperature variations, and the principle is as follows:

When $V_d$ exceeds $V_H$, $V_{C1}$ will be at a high level and $V_{C2}$ will be at a low level to increase $V_{REF}$ and decrease the duty of $V_{SW1}$, and the duty current $I_O$ will be increasing, causing a larger voltage drop of the LED module 200, and thereby lowering down $V_d$.

When $V_d$ falls below $V_L$, $V_{C1}$ will be at a low level and $V_{C2}$ will be at a high level to decrease $V_{REF}$ and increase the duty of $V_{SW1}$, and the duty current $I_O$ will be decreasing, causing a smaller voltage drop of the LED module 200, and thereby pulling up $V_d$.

With $V_d$ being regulated in a safe voltage band and with the duty current $I_O$ and the duty of $V_{SW1}$ varying in opposite directions to result in a bounded power dissipation of the LED driver 210, the power dissipation of the LED driver 210 will be at a safe level to avoid the LED driver 210 from getting overheated, and thereby prolong the operating lifetime of the LED lighting apparatus.

Figure 3:
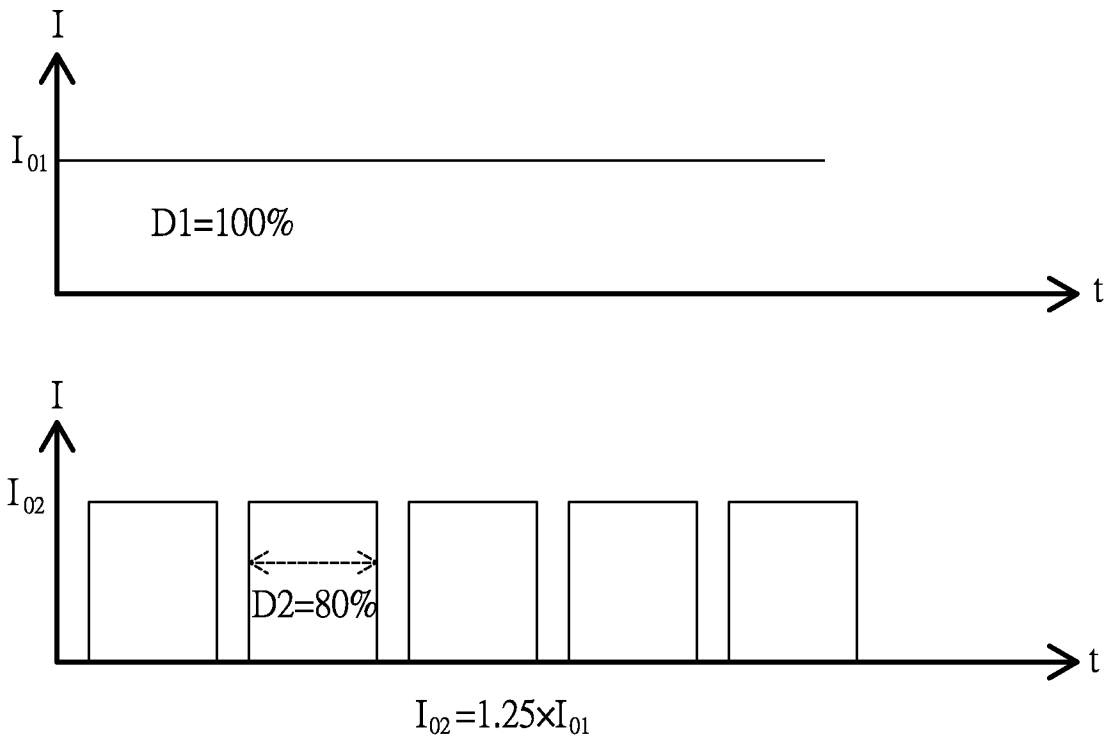
FIG. 3 illustrates two waveforms of an output current of an LED lighting apparatus using a constant current design of the present invention when the LED lighting apparatus is operating under two different environmental conditions.

In addition, if a constant average output current for the LED module 200 is required, a constant current design, which makes the product of the voltage value of $V_{REF}$ and the duty of $V_{SW1}$ a constant, can be used. Please refer to FIG. 3, which illustrates two waveforms of an output current of an LED lighting apparatus using the constant current design of the present invention when the LED lighting apparatus is operating under two different environmental conditions. As illustrated in FIG. 3, when $I_{O2}$ increases to be equal to $1.25*I_{O1}$ due to, for example, an increment of $V_{IN}$ or a decrease of the voltage drop of the LED module 200, the duty meanwhile decreases from D1=100% to D2=80%, to make a same average current.

Based on the principle mentioned above, the amplifier 213, the NMOS transistor 216, and the resistor 217 can also be replaced with a current mirror circuit, which generates the duty current according to $V_{REF}$. As the current mirror circuit is already well known, it is not addressed here.

With the designs elaborated above, the present invention possesses the following advantages:

1. The LED driver of the present invention is capable of regulating its power dissipation when driving an LED module.

2. The LED driver of the present invention is capable of protecting itself from getting overheated when driving an LED module.

3. The LED driver of the present invention is capable of providing a longer operating lifetime for an LED lighting apparatus.

While the invention has been described by way of example and in terms of preferred embodiments, it is to be understood that the invention is not limited thereto. To the contrary, it is intended to cover various modifications and similar arrangements and procedures for example, the NMOS transistor 216 can be replaced with a bipolar transistor, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. An LED driver capable of regulating power dissipation, comprising:

a variable reference voltage generator, used to generate a variable reference voltage in response to a first digital control signal and a second digital control signal in a way that, when said first digital control signal is at a high level and said second digital control signal is at a low level, said variable reference voltage will be increasing; and when said second digital control signal is at a high level and said first digital control signal is at a low level, said variable reference voltage will be decreasing;

a variable duty generator, used to generate a first switching signal and a second switching signal in response to said first digital control signal and said second digital control signal, said second switching signal being a complementary version of said first switching signal;

an amplifier having a positive input end, a negative input end, and an output end, said positive input end being coupled with said variable reference voltage;

a first switch having a first channel end, a second channel end, and a first control end, said first channel end being coupled with said output end of said amplifier, and said first control end being coupled with said first switching signal, wherein, when said first switching signal is at a high level, said first channel end will be coupled electrically with said second channel end;

a second switch having a third channel end, a fourth channel end, and a second control end, said third channel end being coupled with said second channel end of said first switch, said fourth channel end being coupled to a ground, and said second control end being coupled with said second switching signal, wherein, when said second switching signal is at a high level, said third channel end will be coupled electrically with said fourth channel end;

an NMOS transistor having a drain, a gate, and a source, said drain being coupled with one end of an LED module, said gate being coupled with said second channel end of said first switch, and said source being coupled with said negative input end of said amplifier, wherein another end of said LED module is coupled with a line voltage;

a resistor having one end coupled with said source of said NMOS transistor, and another end coupled with said ground;

a first comparator having a first positive input end, a first negative input end, and a first output end, said first positive input end being coupled with said drain of said NMOS transistor, said first negative input end being coupled with a first threshold voltage, and said first output end providing said first digital control signal; and a second comparator having a second positive input end, a second negative input end, and a second output end, said second positive input end being coupled with a second threshold voltage, said second negative input end being coupled with said drain of said NMOS transistor, and said second output end providing said second digital control signal;

wherein, when in operation, a duty current flowing through said LED module will be generated to be equal to a ratio of said variable reference voltage to a resistance of said resistor when said NMOS transistor is turned on, and said first switching signal and said second switching signal, in response to said first digital control signal and said second digital control signal, will control said first switch and said second switch respectively to switch said NMOS transistor and thereby maintain a constant average current flowing through said LED module.

2. The LED driver capable of regulating power dissipation as disclosed in claim 1, wherein said line voltage is selected from a group consisting of a DC voltage, a half-wave rectified voltage, and a full-wave rectified voltage.

3. The LED driver capable of regulating power dissipation as disclosed in claim 1, wherein said variable reference voltage generator includes an up/down counter and a digital-to-analog converter, and said up/down counter will count upwards when said first digital control signal is at a high level and said second digital control signal is at a low level, and count downwards when said second digital control signal is at a high level and said first digital control signal is at a low level.

4. The LED driver capable of regulating power dissipation as disclosed in claim 1, wherein said variable reference voltage generator includes a current source, a capacitor, and a switch circuit, and said switch circuit will make said current source charge said capacitor when said first digital control signal is at a high level and said second digital control signal is at a low level, and couple a discharging path with said capacitor to discharge said capacitor when said second digital control signal is at a high level and said second digital control signal is at a low level.

5. The LED driver capable of regulating power dissipation as disclosed in claim 1, wherein said variable duty generator comprises an oscillator, which provides said first switching signal and said second switching signal, and said duties thereof are controlled by said first digital control signal and said second digital control signal.

6. An LED lighting apparatus, comprising:

an LED module including at least one LED, having a first end and a second end, said first end being coupled with a line voltage, which is a processed voltage from an AC line;

a variable reference voltage generator, used to generate a variable reference voltage in response to a first digital control signal and a second digital control signal in a way that, when said first digital control signal is at a high level and said second digital control signal is at a low level, said variable reference voltage will be increasing; and when said second digital control signal is at a high level and said first digital control signal is at a low level, said variable reference voltage will be decreasing;

a variable duty generator, used to generate a first switching signal and a second switching signal in response to said first digital control signal and said second digital control signal, said second switching signal being a complementary version of said first switching signal;

an amplifier having a positive input end, a negative input end, and an output end, said positive input end being coupled with said variable reference voltage;

a first switch having a first channel end, a second channel end, and a first control end, said first channel end being coupled with said output end of said amplifier, and said first control end being coupled with said first switching signal, wherein, when said first switching signal is at a high level, said first channel end will be coupled electrically with said second channel end;

a second switch having a third channel end, a fourth channel end, and a second control end, said third channel end being coupled with said second channel end of said first switch, said fourth channel end being coupled to a ground, and said second control end being coupled with said second switching signal, wherein, when said second switching signal is at a high level, said third channel end will be coupled electrically with said fourth channel end;

an NMOS transistor having a drain, a gate, and a source, said drain being coupled with said second end of said LED module, said gate being coupled with said second channel end of said first switch, and said source being coupled with said negative input end of said amplifier, wherein another end of said LED module is coupled with a line voltage;

a resistor having one end coupled with said source of said NMOS transistor, and another end coupled with said ground;

a first comparator having a first positive input end, a first negative input end, and a first output end, said first positive input end being coupled with said drain of said NMOS transistor, said first negative input end being coupled with a first threshold voltage, and said first output end providing said first digital control signal; and a second comparator having a second positive input end, a second negative input end, and a second output end, said second positive input end being coupled with a second threshold voltage, said second negative input end being coupled with said drain of said NMOS transistor, and said second output end providing said second digital control signal;

wherein, when in operation, a duty current flowing through said LED module will be generated to be equal to a ratio of said variable reference voltage to a resistance of said resistor when said NMOS transistor is turned on, and said first switching signal and said second switching signal, in response to said first digital control signal and said second digital control signal, will control said first switch and said second switch respectively to switch said NMOS transistor and thereby maintain a constant average current flowing through said LED module.

7. The LED lighting apparatus as disclosed in claim 6, wherein said line voltage is selected from a group consisting of a DC voltage, a half-wave rectified voltage, and a full-wave rectified voltage.

8. The LED lighting apparatus as disclosed in claim 6, wherein said variable reference voltage generator includes an up/down counter and a digital-to-analog converter, and said up/down counter will count upwards when said first digital control signal is at a high level and said second digital control signal is at a low level, and count downwards when said second digital control signal is at a high level and said first digital control signal is at a low level.

9. The LED lighting apparatus as disclosed in claim 6, wherein said variable reference voltage generator includes a current source, a capacitor, and a switch circuit, and said switch circuit will make said current source charge said capacitor when said first digital control signal is at a high level and said second digital control signal is at a low level, and couple a discharging path with said capacitor to discharge said capacitor when said second digital control signal is at a high level and said second digital control signal is at a low level.

10. The LED lighting apparatus as disclosed in claim 6, wherein said variable duty generator comprises an oscillator, which provides said first switching signal and said second switching signal, and said duties thereof are controlled by said first digital control signal and said second digital control signal.

* * * * *